US010704208B1

(12) United States Patent
Prather

(10) Patent No.: US 10,704,208 B1
(45) Date of Patent: Jul. 7, 2020

(54) ASPHALT PAVER WITH REMIXER

(71) Applicant: Justin Prather, Olivehurst, CA (US)

(72) Inventor: Justin Prather, Olivehurst, CA (US)

( * ) Notice: Subject to any disclaimer, the term of this patent is extended or adjusted under 35 U.S.C. 154(b) by 0 days.

(21) Appl. No.: 16/206,623

(22) Filed: Nov. 30, 2018

Related U.S. Application Data

(60) Provisional application No. 62/595,460, filed on Dec. 6, 2017.

(51) Int. Cl.
*E01C 19/00* (2006.01)
*E01C 19/48* (2006.01)
*E01C 19/40* (2006.01)

(52) U.S. Cl.
CPC ..... *E01C 19/4853* (2013.01); *E01C 19/40* (2013.01); *E01C 2301/10* (2013.01); *E01C 2301/16* (2013.01)

(58) Field of Classification Search
CPC .. E01C 19/40; E01C 19/4853; E01C 2301/10; E01C 2301/16
USPC ..... 404/82–118
See application file for complete search history.

(56) References Cited

U.S. PATENT DOCUMENTS 4,272,212 A * 6/1981 Bauer, Jr. ..... E01C 7/187 106/283
5,405,214 A 4/1995 Campbell
5,529,434 A * 6/1996 Swisher, Jr. ..... E01C 19/48 404/108
5,533,829 A 7/1996 Campbell
5,615,973 A 4/1997 Campbell
2009/0324332 A1* 12/2009 Hood ..... E01C 19/00 404/113
2010/0178107 A1* 7/2010 Braddy ..... E01C 19/182 404/75
2013/0223927 A1* 8/2013 Mings ..... G01S 15/88 404/72
2015/0204028 A1* 7/2015 Swearingen ..... E01C 19/48 404/108
2018/0347123 A1* 12/2018 Hoffmann ..... E01C 19/00
2019/0078273 A1* 3/2019 Neisen ..... E01C 23/00

OTHER PUBLICATIONS

BOMAG FAYAT Group; Rubber Tire Asphalt Paver; Cedarapids CR552.
ROADTEC; SB-2500 Shuttle Buggy.
ROADTEC; SB-2500e/ex Material Transfer Vehicle.

* cited by examiner

*Primary Examiner* — Raymond W Addie
(74) *Attorney, Agent, or Firm* — Heisler & Associates

(57) ABSTRACT

A wheeled asphalt paver vehicle provides a combination of a remixing hopper and a paving screed in a single vehicle. An optional loading conveyor carried by the vehicle facilitates loading of asphalt mix or other paving material into the hopper. A mixer within a lower portion of the hopper keeps the asphalt materials mixed therein. An output conveyor draws asphalt material from the hopper and into a screed for laying onto a surface over which the vehicle is traveling. An optional flow diverter between the output conveyor and the screed is adjustable to provide a greater proportion of the asphalt material to a left side or a right side of the screed. The vehicle can conveniently be controlled by fewer operators than when a separate paver vehicle and a separate remixer vehicle are utilized.

13 Claims, 4 Drawing Sheets

ASPHALT PAVER WITH REMIXER

CROSS-REFERENCE TO RELATED APPLICATIONS

This application claims benefit under Title 35, United States Code § 119(e) of U.S. Provisional Application No. 62/595,460 filed on Dec. 6, 2017.

FIELD OF THE INVENTION

The following invention relates to wheeled paving vehicles which included both a hopper with a mixer therein to keep the material mixed and homogenous, and to paving vehicles with a screed assembly carried by the vehicle for laying of a smooth layer of asphalt upon an underlying surface over which the vehicle is traveling.

BACKGROUND OF THE INVENTION

When paving a roadway with asphalt, a layer of asphalt is laid down by a paver machine. This paver machine in the prior art typically includes a hopper on a forward portion thereof and a screed on a rearward portion thereof. The paver machine is typically self-propelled including drive wheels (or tracks), a motor, and a station for at least one operator, and typically one operator to drive the paver while another operator controls a height of the screed and other details of the operation of the paver.

Before the paver can be used, the hopper must be loaded with hot asphalt. Typically hot asphalt is manufactured at an asphalt plant, loaded into a dump truck, and then the dump truck travels to where the paver is located and where the paving of the roadway is occurring. The dump truck will then dump the asphalt into the hopper of the paver so that the paving can occur. With such dump truck direct loading of the hopper, the paver is less than entirely satisfactory in many circumstances. Asphalt cannot typically be dumped by tilting a bed of the dump truck on the largest of trucks, due to their great lengths, and greater capacity than the paver hopper.

Also, during handling of the asphalt it can often become somewhat segregated into different portions of the asphalt mix having different characteristics, rather than staying thoroughly mixed, in a phenomena called "segregation." Finally, the asphalt carrying dump trucks typically have to remain on site until the paver is ready to receive a load of the asphalt from the dump truck. This can require multiple dump trucks sitting idol waiting for their "turn" to load the hopper of the paver. The dump trucks are not kept moving and efficiency (and costs) of the operation are negatively impacted. This problem is compounded when smaller dump trucks are required to accommodate the size of the hopper, which is typically smaller than a size which could be carried by the longest and largest capacity trucks.

The common way to solve this problem, and for efficient utilization of the asphalt carrying trucks, is to utilize trucks which dump from a belly of an asphalt trailer directly onto the ground in a "windrow," and then have a separate machine which picks the asphalt up off of the ground and loads the hopper of the paver. Such a methodology allows the asphalt carrying trucks to keep moving substantially continuously, and not having to sit idle. However, once the asphalt is on the ground, a separate machine is required which can pick up the asphalt off of the ground and load it into the hopper of the paver. Also, a windrow of asphalt on the ground, unless acted upon quickly, has a somewhat excess tendency to cool, which is undesirable in asphalt paving. Furthermore, the segregation of different components within the asphalt mix when dumping onto the ground and picking up and loading into the hopper of the paver is to some extent accentuated.

One prior art method to deal with some of these problems is to utilize a remixer for both picking up the asphalt off the ground, remixing the asphalt back to a homogeneous character, and keeping the asphalt in a hopper of the remixer until it is ready to be loaded into the hopper of the paver. This tends to minimize surface area of a mass of asphalt that is exposed to the air, so that cooling of the asphalt mix is slowed at least somewhat. Such remixers can also be used with standard dump trucks to improve the quality of the asphalt being passed on to the paver. However, disadvantageously such remixers require one further complex machine to be purchased, maintained and operated, as well as the additional personnel to operate the remixer, so that inefficiencies still remain. Even if all of the vehicles act smoothly together, the complexity and length/size of the train of vehicles and various conveyors, leaves significant opportunity for undesirable asphalt cooling. Furthermore, the hopper within the remixer and the hopper within the asphalt paver are to some extent redundant. Accordingly, opportunities exist for further improvement of paving systems.

SUMMARY OF THE INVENTION

With this invention, a paver is provided with an integrated self-loading mixer. This machine is in the form of a self-propelled wheeled vehicle having a large central hopper (e.g. 25 tons) riding upon at least four large wheels which spread out the weight of this load over the underlying surface effectively. The hopper is fed (in one embodiment) by a conveyor carried on a front end of the vehicle and optionally with a feed auger on a front portion of this conveyor. The conveyor is angled rearwardly and upwardly to allow the feed auger and associated feed head to rest directly adjacent to the ground. The feed head can thus pick up a windrow of asphalt having been deposited on the ground by a belly dump. Alternatively, a standard dump truck can dump from a tailgate directly into the front portion of the conveyor, allowing the asphalt to be kept off of the ground if desired.

The augers of a feed head of such an optional loading conveyor rotate appropriately, along with the conveyor to lift up the asphalt mix off of the ground (or however loaded) and carry it up over the hopper and then drop it into the hopper. This large hopper has a relatively small surface area, so that the asphalt within the hopper only cools slowly due to heat transfer to surrounding air.

To keep the asphalt mix effectively remixed, a remixing auger (or other mixer) is provided in a lowermost portion of the hopper. This mixing auger (or set of augers or other mixers) rotates and helps to keep the asphalt material in a homogenous remixed state, especially at a lowermost part of the hopper near where it is conveyed out of the hopper, so that asphalt mix delivered from the hopper has a high quality, non-segregated character and including relatively high temperature.

An output conveyor is located on a lowermost portion of the hopper, directly to a rear of the mixing auger. The output conveyor is oriented diagonally with a lower forward end to a rear of the mixing auger. When the mixing augers are rotating, they tend to present well mixed asphalt material directly adjacent to this output conveyor. The output conveyor rotates to force the asphalt up a slide surface (or upon a top of a conveyor belt if desired) to a rearmost portion of the hopper and somewhat elevated before depositing the asphalt through a chute leading to the screed portion of a paver assembly.

The screed assembly is carried to a rear side of a rear axle of this machine/vehicle below and to a rear of the hopper. The output conveyer extends sufficiently rearward that asphalt material being delivered off of the output conveyor falls down onto a feed portion of the screed, the feed portion being akin to portions of a prior art paver's hopper just upstream of the feed/spreading augers of the screed. The screed preferably includes spreading augers forward of the screed itself into which the asphalt material is delivered when it falls from a rear portion of the output conveyor, such as along a chute. This spreading auger spreads the asphalt material to sides of the screed where it is needed for paving.

The screed can have a tendency to be fed with too much asphalt on one side or to little asphalt on one side, compared to the other side. The screed is extendable laterally with utilization of spreading augers to spread out the asphalt and fill the entire screed structure from between a left and a right hand and to match a desired width for a paving layer. To ensure that the spreading augers are effectively fed with an appropriate amount of asphalt mix (not too much and not too little, at least one flow diverter is provided between the output end of the output conveyor and the spreading augers or other downstream portions of the screed assembly). The flow diverter in one form is a flapper which is controlled to move to the left or the right to divert the asphalt mix more to the left or more to the right when feeding the spreading augers of the screed.

An operator can visually inspect the spreader augers and if one of the spreader augers has a disproportionate amount of asphalt mix compared to the other, the operator adjusts this flapper to divert more of the asphalt mix coming off of the output end of the output conveyor to the left or to the right, appropriately to rebalance flow of asphalt mix. In an exemplary embodiment, two such flappers are provided on lateral sides of the chute.

While in a preferred embodiment this diversion of asphalt mix to the left or to the right by the door is controlled by an operator visually inspecting the spreading augers (or other parts of the system), such a system could be automatically controlled or at least partially automatically controlled, such as by utilizing a machine vision system inspecting the spreader augers and feeding back control inputs to the flow diverter to divert asphalt mix appropriately to automatically rebalance the paver assembly a head of the screed. Such a system could alternatively operate with input from flow sensors or feed sensors which measure a flow rate of asphalt material within each of the spreader augers (or other parts of the system downstream of the chute) and makes adjustments accordingly when sensing insufficient (or excessive) flow associated with too much or too little asphalt mix upon a side, and to match preferred practices as dictated by the theory of paving.

If desired, a small hopper (or other buffer space) could be provided just upstream of the spreader augers, taking the place to some extent of the full hopper on a typical asphalt paver, but much smaller and carried by the same chassis as the overall machine of this invention. While the spreading auger would be a primary area for sensing whether the asphalt mix needs to be diverted more effectively to the left or to the right, such measurement could occur downstream of or upstream of the spreading augers to provide such balance. Also, a control system (or operator) can watch for insufficient asphalt mix overall and restart or speed up the output conveyor to maintain proper asphalt flow. Conversely, such a control system (or operator) can slow down or stop the output conveyor if excess asphalt is delivered to the paver subassembly overall, than is needed.

While conceivably a single operator could operate this vehicle and perform all of the functions from take up of asphalt off of the ground, operating the remixer and hopper, as well as the output conveyor, left and right balance and control of asphalt mix flow into a screed assembly, and screed operation details, most typically two operators would be utilized. One operator would be "driving" the machine/vehicle and operating the pick up auger and remixing auger within the hopper, as well as perhaps the output conveyor, and a second operator would be operating the screed assembly and screed, and perhaps also the left and right rebalancing control at the chute, and optionally also the output conveyor.

Ultimately, a single vehicle is involved with typically two operators. This contrasts favorably with prior art systems which include a remix vehicle (or at least a pick up vehicle) separate from a paver vehicle, and requiring typically three operators including a driver of the remix vehicle, a driver of the paver and an operator of the screed. Some of the functions of the prior art system are entirely eliminated. For instance, no paver driver needs to be constantly monitoring position of the paver relative to the remixer to keep them aligned. Rather, they are integrated together and remain properly aligned at all times. Furthermore, only half as much equipment needs to be transported and maintained (one machine instead of two). Elements of the machinery including operating motors and wheels are reduced by approximately half, while still maintaining all of the same function. One hopper is eliminated, decreasing further opportunity for asphalt mix cooling.

Furthermore, typical remixer machines include an output conveyor as well as a large conveyor boom which is adjustable to feed the hopper of the prior art paver. This large transfer conveyor boom at the rear of the remixer is eliminated by this invention, along with the complexity of this subassembly and the operator time required to control this element. Ultimately, the function of equipment known in the prior art is achieved (and in fact exceeded) with fewer elements and with a simpler overall configuration.

OBJECTS OF THE INVENTION

Accordingly, a primary object of the present invention is to provide for paving with a homogenous mixture of asphalt materials.

Another object of the present invention is to provide a paver vehicle which keeps asphalt material being paved from cooling an excessive amount.

Another object of the present invention is to provide an asphalt paving vehicle which can take asphalt from a supply truck, either directly or after placement on the ground, and keep the asphalt material both remixed and paved with a single vehicle and with a minimum number of operators, which would typically be two operators.

Another object of the present invention is to provide an asphalt paving machine which delivers asphalt material from a hopper into a screed with a flow diverter which can divert a greater or lesser portion of asphalt material to a left side or right side of the screed, to keep the screed from running out of asphalt materials and avoiding voids during paving, even if the screed is configured in an asymmetrical manner.

Another object of the present invention is to minimize a number of vehicles required to pave asphalt material.

Another object of the present invention is to simplify the process of paving asphalt materials.

Another object of the present invention is to increase a speed at which asphalt materials can be paved onto an underlying surface.

Another object of the present invention is to enhance performance of asphalt paving material, at least partially by allowing the asphalt material to be paved at a higher temperature.

Another object of the present invention is to expand an effective paving season at least partially by keeping the asphalt material warm enough to allow for paving in lower ambient temperatures than would otherwise be effective.

Other further objects of the present invention will become apparent from a careful reading of the included drawing figures, the claims and detailed description of the invention.

DESCRIPTION OF THE PREFERRED EMBODIMENT

Figure 1:
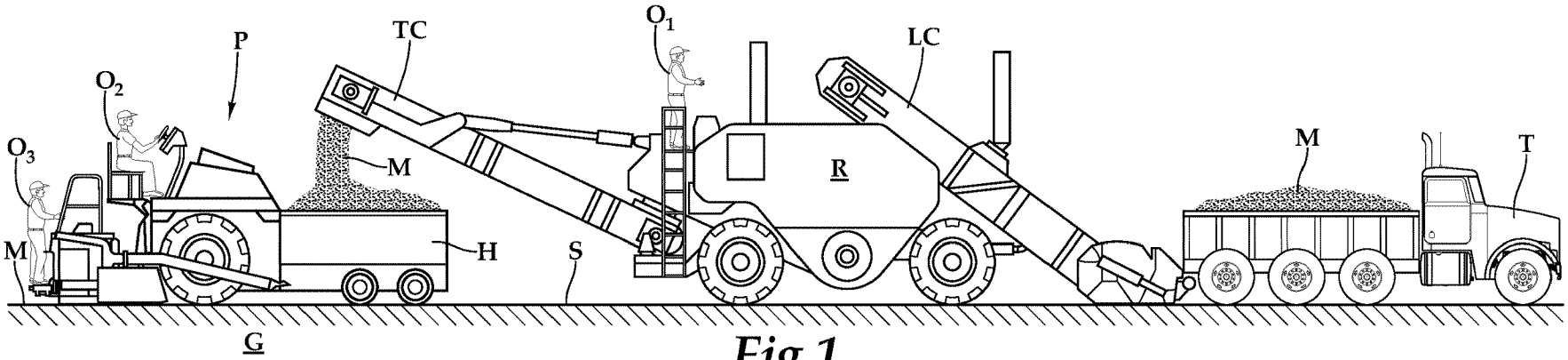
Fig.1 (PRIOR ART)
FIG. 1 is a side elevation view of a prior art train of multiple vehicles utilized in traditional prior art paving operations, where a remixer is called for to keep the asphalt material homogenous before paving.

Referring to the drawings, wherein like reference numerals represent like parts throughout the various drawing figures, reference numeral 10 is directed to a system for paving (FIGS. 2-4) which has various benefits according to this invention. The system 10 keeps asphalt material M both remixed and homogenous, and handled in a minimal amount, to allow for maintenance of elevated temperature of the material M. The system 10 importantly keeping a screed assembly 80 supported upon a single vehicle along with a remixing hopper 20, so that a separate paver P vehicle is eliminated (FIG. 1) and a lesser number of operators is required to perform the paving function.

Figure 2:
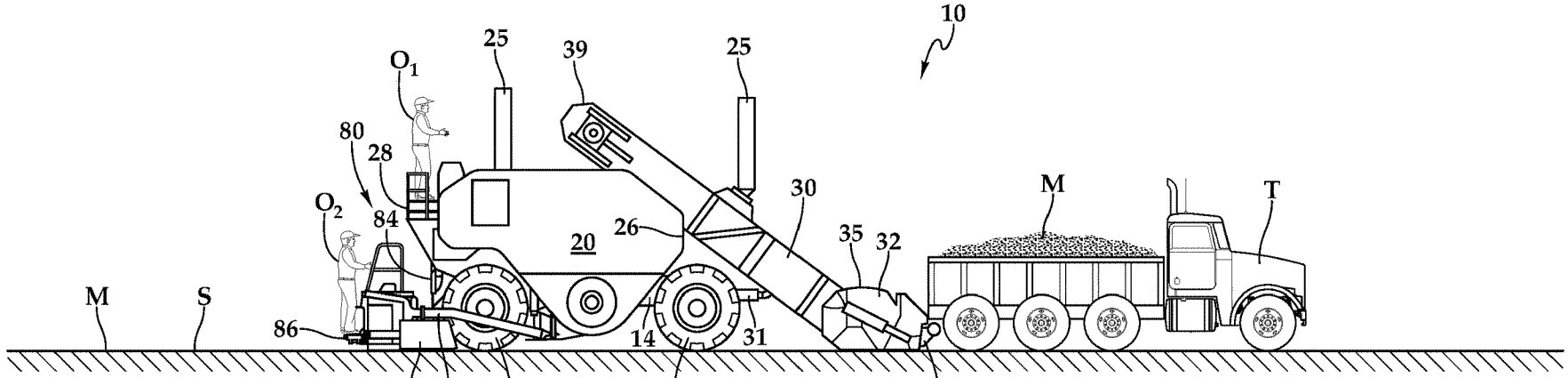
FIG. 2 is a side elevation view of the paving system of one embodiment of this invention, and illustrating how one vehicle is avoided and at least one operator is avoided, while still achieving the same paving result.
Figure 4:
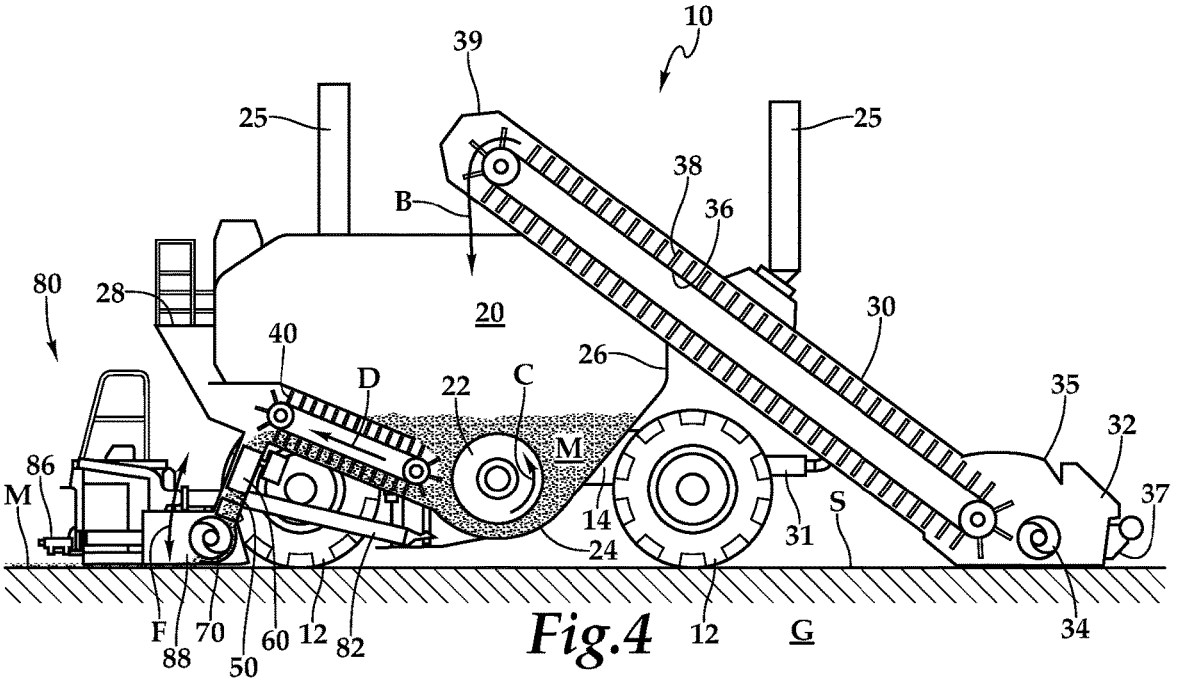
FIG. 4 is a side elevation full sectional view of that which is shown in FIG. 3.

In essence, and with particular reference to FIG. 4, basic details of the system 10 are described, according to an exemplary environment. The system 10 includes a single wheeled vehicle carrying a hopper 20 for support of asphalt material M therein, before paving of the material M onto a surface S of the ground G over which the vehicle of the system 10 is traveling. A loading conveyor 30 is optionally provided on the vehicle, which loads material into the hopper 20. This loading conveyor 30 preferably can either pick up asphalt material M off of the ground G or can have asphalt material M dumped directly therein from a truck T (FIGS. 1 and 2). The hopper 20 is configured to keep the asphalt material M remixed and homogenous.

An output conveyor 40 is located at least partially within the hopper 20 and carries the material M out of the hopper 20 and toward a screed assembly 80 for paving of the asphalt material M onto the ground G. A chute 50 includes flow diverters, such as in the form of flappers 60, which can be positioned to divert flow of asphalt material M more to the left or more to the right, upstream of augers 70 which evenly distribute asphalt material M to the screed assembly 80 for paving. The screed assembly 80 is carried by the same wheeled vehicle of the system 10, so that a separate paver P vehicle (FIG. 1) is avoided. The heat loss and temperature reduction of the material M is minimized by elimination (or at least shrinking a size of a hopper associated with the screed assembly 80), and avoiding the complexity and temperature loss associated with a transfer conveyor TC (FIG. 1).

With particular reference to FIG. 1, details of a prior art paving system are described, of which the system 10 of this invention is an improvement. One form of prior art paving system starts with a truck T carrying asphalt material M and either dumping the material M directly into a loading conveyor LC or dumping the material M onto the ground before it is then picked up by a loading conveyor LC. In other embodiments, the material M can be dropped directly into a hopper, such as that of a paver P, if no remixing is required.

Beneficially, it is known in the prior art to have the loading conveyor LC load the material M into a remixer R which includes an auger or other mixing element at a lower portion of a hopper thereof, to keep the material M homogenous. An output conveyor feeds the material M from the remixer onto a transfer conveyor TC, which then elevates the material M over a hopper H of a separate paver P vehicle trailing behind the separate remixer R vehicle. This paver P is then used to feed the material M through distribution augers and a screed for laying down a desired layer of pavement onto the ground G.

Such prior art paving systems typically include at least three operators other than the operator of the truck T. These operators include a driver of the remixer R ($O_1$), as well as two operators on the paver P, one ($O_2$) to drive the paver P and the other ($O_3$) to control the screed and other portions of the paver P, to lay down the proper desired amount of material and in the proper position to meet design specifications ($O_2$ and $O_3$).

Opportunities for heat loss include when the material M is within the truck, when the material is resting on the ground before being picked up by the loading conveyor LC, residence time within the remixer R, exposure to surrounding air and residence time traveling through the loading conveyor LC and the transfer conveyor TC, and falling from the transfer conveyor TC into the hopper H of the paver P, as well as residence time within the hopper H of the paver P, before final laying down of the material M upon the ground G as pavement. With the multiple vehicles associated with prior art systems, complex logistics and coordinations are involved, to keep the vehicles operating optimally and with minimal delay, which can affect paving quality due to loss of temperature of the paving material M. With a single vehicle downstream of the truck T, logistics are simplified, so that a fewer number of operators can more easily provide a higher quality pavement.

Figure 3:
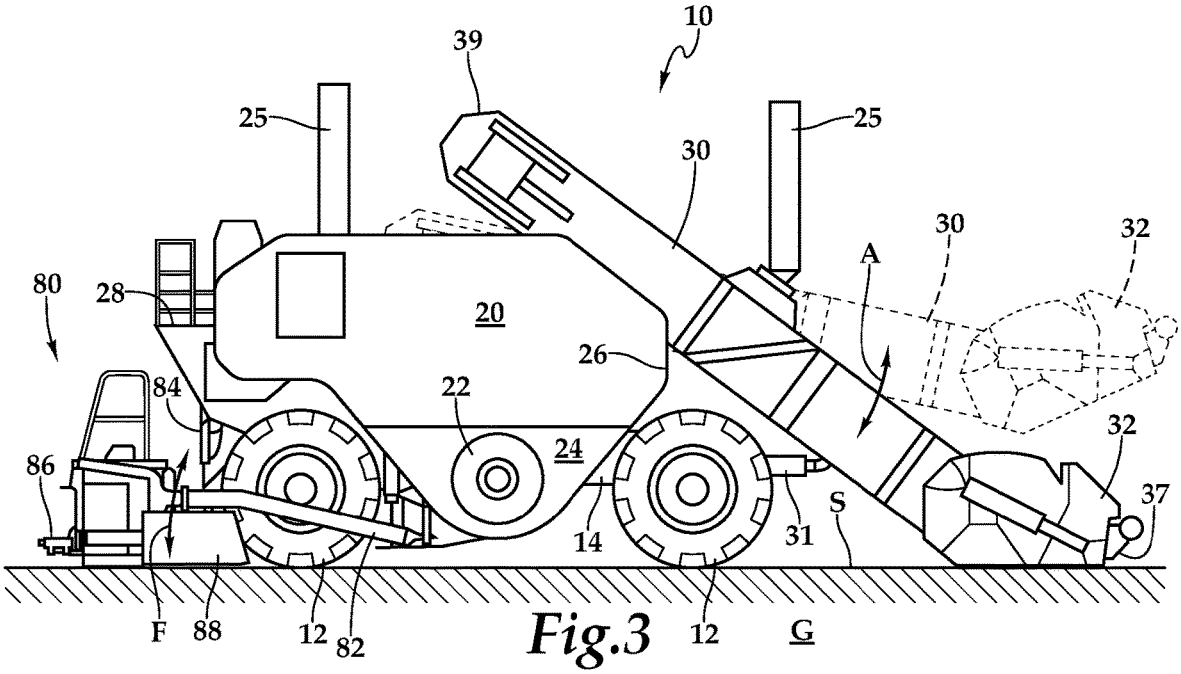
FIG. 3 as a side elevation view of a paving vehicle according to an exemplary embodiment of this invention, and with an optional loading conveyor associated therewith, shown in broken lines in a second elevated position relative to a first position, to illustrate how the loading conveyor can operate on the ground or above the ground.

More specifically, and with particular reference to FIGS. 3 and 4, details of the hopper 20 and optional loading conveyor 30 of the system 10 are described, according to an exemplary embodiment. In many respects, the hopper 20 and the loading conveyor 30 of the system 10 of this invention can be similar to those of the remixer R of the prior art. The hopper 20 is carried upon wheels 12 which support a frame 14 of a vehicle which implements the system 10 of this invention. This hopper 20 has a large material M containment vessel which comprises a majority of a volume taken up by the vehicle supporting the hopper 20. The containment vessel includes outer walls 26 and with a sump 24 at the lower portion thereof, which typically has a smaller horizontal cross-sectional area than portions of the containment vessel above the sump 24.

A mixing element, or other mixer, is provided within this sump 24 or otherwise within the hopper 20. In one form, this mixer is a remix auger 22 (or multiple remix augers 22) located within the sump 24 and rotating about an axis perpendicular to the direction of material M flow passing along the loading conveyor LC, and thus transverse to a direction in which the vehicle of the system 10 travels, when rolling upon the wheels 12 thereof.

The remix auger 22 or other mixing element causes different constituencies of the paving material M, such as asphalt, to be returned to and maintained in a homogenous form. When asphalt material M is dumped onto the ground, or otherwise dumped directly into a loading conveyor LC, and when such material M passes over various different conveyors, and when such material falls from conveyors into hoppers, the material M has a tendency to become somewhat stratified and non-homogenous (called "segregation"), such as with higher density elements of the material M concentrated at lower portions of the material M. Such segregation is generally undesirable. The remix auger 22 causes a blending of the material M to keep it at a greater degree of homogeneity than would otherwise be the case. The hopper 20 also supports an upper platform 28 upon which an operator $O_1$ can stand or sit. This operator $O_1$ can have a primary responsibility of driving the vehicle of the system 10, and to control the remix auger 22, and the loading conveyor LC.

The loading conveyor LC is an optional element which assists in loading material M into the hopper 20. Without the loading conveyor LC, a separate loading vehicle or apparatus could be utilized, or material M from a truck T could conceivably be dumped directly into the hopper H, if the truck T or other vehicle were appropriately configured. Most preferably, the loading conveyor LC is provided and mounted upon the frame 14 of the vehicle of the system 10, so that the truck T does not need to be concerned about how the material M will be placed into the hopper 20.

In this exemplary embodiment, the loading conveyor LC is provided, which can pick up material M off of the surfaces of the ground G. A feed head 32 is located at a lower forward portion of the loading conveyor 30 and generally resting upon the ground G or near the ground G. A lift ram 31 allows for the feed head 32 to be raised or lowered, and for the entire loading conveyor 30 to be tilted relative to the frame 14 of the vehicle of the system 10. The lift ram 31 allows for lifting of the loading conveyor 30, such that the vehicle of the system 10 can more readily drive when not actively engaged in a paving operation, or to pick up the loading conveyor LC, when material M does not need to be picked up, or to accommodate changes in the steepness of the grade of the surface S over which the vehicle of the system 10 is operating.

This lift ram 31 provides a preferred form of lifter for the loading conveyor LC, but other lifters could alternatively be provided, such as lifting belt, lifting chains, electromechanical elements such as motors, either direct drive coupled to pivoting joints of the loading conveyor LC, or coupled thereto through linkages, such as four bar linkages or other linkages, to achieve loading conveyor LC re-positioning.

The feed head 32 preferably includes a top opening 35 and a front entry 37. The front entry 37 can be opened or closed. When open, it facilitates the feed head 32 and a pick up auger 34 within the feed head 32, picking material up off the ground directly and feeding it onto a belt 36 of the loading conveyor 30. Alternatively, the front entry 37 can be closed and a top opening 35 utilized by dumping of material M directly into the feed head 32, such as by dumping material M with a truck T in the form of a dump truck.

The belt 36 preferably includes ribs 38 thereon and the belt 32 is rotatably supported upon spindles and with appropriate drive motors to cause the belt 36 to rotate about the spindles, and with the ribs 38 carrying material M to the upper end 39 overlaying the hopper 20. Re-positioning of a height of the loading conveyor LC occurs along arrow A of FIG. 3. Movement of material M through the loading conveyor LC and into the hopper 20 occurs along arrow B of FIG. 4. Rotation of the remix auger 22, as one form of mixer within the hopper 20, occurs along arrow C (or in the direction opposite that of arrow C as a possible option), or with counter rotating portions which rotate in both directions, within the hopper 20.

Figure 5:
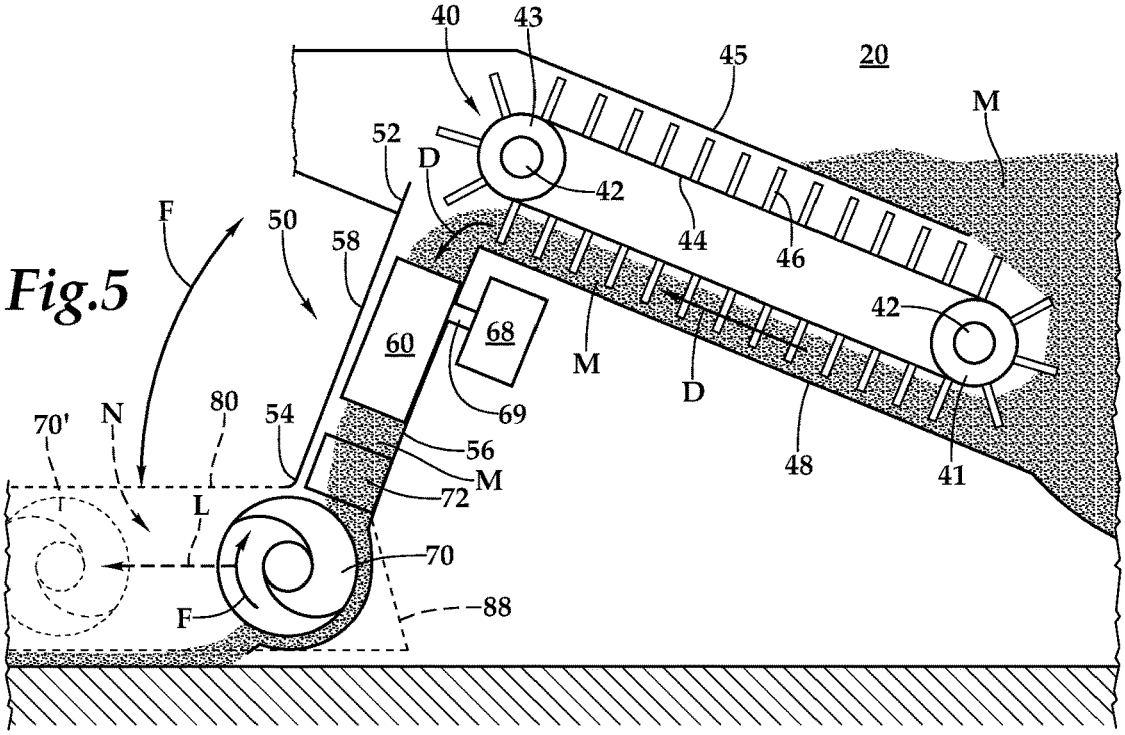
FIG. 5 is a side elevation detail of a portion of that which is shown in FIG. 4, and illustrating in detail how an output conveyor and chute deliver asphalt material out of a remixing hopper and into a screed assembly of the vehicle.
Figure 6:
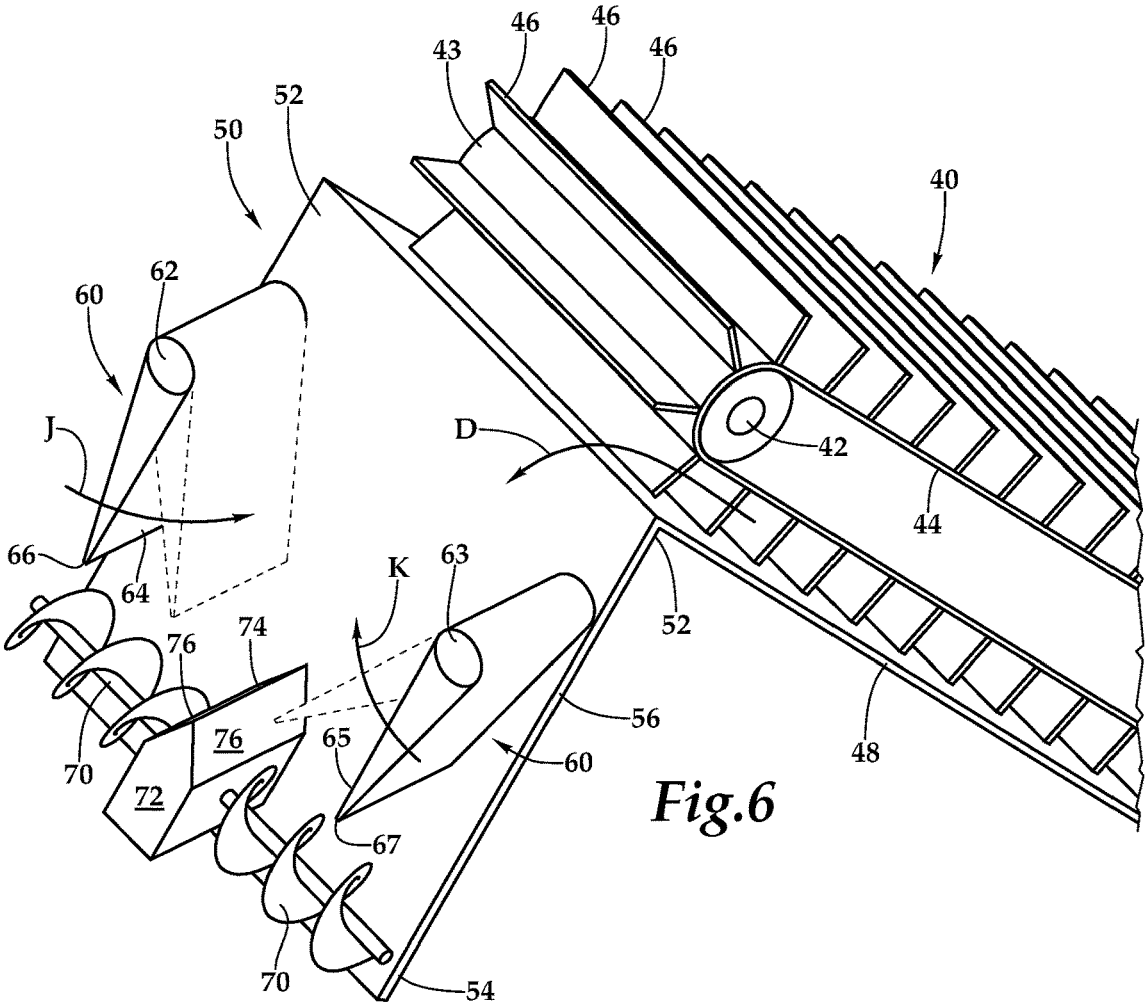
FIG. 6 is a perspective view of that which is shown in FIG. 5.

With particular reference to FIGS. 4-6, details of the output conveyor 40 which removes material M from the hopper 20 are described. The output conveyor provides a preferred form of means to remove material M from the hopper 20 and deliver it to a screed assembly 80 of the system 10. The output conveyor 40 includes a lower forward end 41 opposite an upper rearward end 43. Spindles 42 are parallel to each other and support a belt 44 rotating over the spindles 42 and extending tightly between the spindles 42.

Preferably, the belt 44 includes ribs 46 extending laterally therefrom. The output conveyor 40 is located over a slide surface 48 which remains parallel to and beneath the belt 44. The ribs 46 extend toward the slide surface 48 and optionally into contact with this slide surface 48. The output conveyor rotates so that a lower circuit of the belt 44 moves upwardly and rearwardly adjacent to the slide surface 48. Material M is captured between the ribs 46 of the belt 44 and the slide surface 48, and is caused to slide up the slide surface 48 (along arrow D of FIG. 4).

A hood 45 overlies the belt 44 of the output conveyor 40 over at least a portion of its length. Material M can rest upon the hood 48 with the hood 45 keeping the material M from accessing the output conveyor 40 before the material M has encountered the remix auger 22 or other mixer within the hopper 20. In one embodiment, the lower forward end 41 of the output conveyor 40, including the belt 44 and ribs 46 thereof, act to some extent along with the remix auger 22 to assist in mixing of the material M just before it is pulled by the output conveyor 40 up the slide surface 48 and is caused to exit the hopper 20.

Control of the output conveyor 40 can include control of a speed and/or power with which at least one motor operates, which motor is coupled to at least one of the spindles 42 of the output conveyor 40, or otherwise configured, such as through a chain drive to one of the spindles 42, or directly to the belt 44. Such control can include speeding up or slowing down the output converter 40, such as to cause material M to flow from the hopper 20 at a desired speed to keep the screed assembly 80 properly filled with material M during paving. If too much material M is being fed to the screed assembly 80, the output conveyor 40 can slow down to a slower speed, or be temporarily stopped. If not enough material M is being fed to the screed assembly 80, the output conveyor 40 can be sped up to deliver material more quickly.

Skilled operators can watch the flow of material M and control the speed of the output conveyor 40 accordingly. Other forms of control include speeding up or slowing down the vehicle of the system 10 so that speed of the paving process does not get ahead of the speed at which material is flowing into the screed assembly 80. As an alternative (or in addition to the above), sensors can be incorporated into a control system, such as with the sensors providing automatic feedback and control, so that material M is caused to flow to the screed assembly 80 from the hopper 20 at an optimal speed.

As one example, an operator can merely drive the vehicle of the system 10 at a desired speed (perhaps between a pre-set maximum and minimum values), and sensors of the control system then sense material M presence, such as within the screed assembly 80, or just upstream of the screed assembly 80, and provide a control signal to the output conveyor 40 to provide more or less material M to the screed assembly 80, based on readings from the sensors, and perhaps also partially based on speed at which the operator is driving the vehicle of the system 10. Thus, generally, as the operator drives the vehicle of the system 10 more quickly, the output conveyor 40 would automatically speed up to compensate. Other forms of volumetric control could also be utilized, such as changing an elevation of the belt 44 about the conveyor 40 relative to the slide surface 48, so that a greater or lessor volumetric flow rate of material is carried without requiring change of rotational speed of the belt 44 of the output conveyor 40.

With particular reference to FIGS. 5 and 6, details of a chute 50 downstream of the output conveyor 40 and upstream of the screed assembly 80 are described, according to this exemplary embodiment. In a simplest embodiment, the upper rearward end 43 of the output conveyor 40 merely drops material M into augers 70 upstream of the screed assembly 80 (or into a small hopper H upstream of the distribution augers 70). By providing the chute 50, a reliable path between the output conveyor 40 and the augers 70 feeding the screed assembly 80, can be provided.

This chute 50 includes an upper end 52 opposite of lower end 54 and with an angled undersurface 56 extending between the upper end 52 in the lower end 54. Preferably, a cover 58 overlies the angled undersurface 56, which cover 58 maintains a parallel position at a constant spacing away from the angled undersurface 56. Lateral sides can also optionally be provided associated with the chute 50. The chute 50 can vary in height when the screed assembly 80 is changed in elevation (such as by lifting along arrow F of FIGS. 3-5), and with an upper end of the chute 50 movable relative to the hopper 20.

In one embodiment, the upper end 52 of the angled undersurface 56 of the chute 50 is hinged, such as with a piano hinge, to an upper end of the slide surface 48, so that a smooth transition is always maintained between the output conveyor 40 and the chute 50. Portions of the cover 58 opposite the upper end 52 of the chute 50 angled under surface 56, can be disconnected from adjacent structures of the hopper 20, to facilitate movement thereof when the chute 50 needs to pivot slightly due to the screed assembly 80 being raised or lowered, such as through operation of the elevation ram 84 to cause pivoting of the screed assembly 80 about the support arm 82.

The screed assembly 80 typically includes distribution augers 70 and a shroud 88 which are adjustable laterally. In this manner, a width of pavement laid down by the screed assembly 80 can be adjusted. Most preferably, the screed assembly 80 can be adjustable to increase width of the pavement, and to control an amount of pavement extending from a midline of the screed assembly 80 to the left and from a midline of the screed assembly 80 to the right, independently of each other. Typical prior art pavers P (FIG. 1) include a hopper H which includes separate left and right loading paths to keep the screed appropriately filled on left and right sides thereof, even when a greater or lessor amount of material M is required at left and right sides of the screed assembly 80. Beneficially with this invention, the hopper H associated with the paver P is eliminated, or made into merely a small hopper N, provided only for buffering purposes, and to facilitate proper operation of the distribution augers 70, and other minor further control benefits to be provided.

Without such a prior art system for feeding appropriate amounts of material M to left and right sides of the screed assembly 80, the system of this invention includes a flow diverter. This flow diverter is preferably in the form of at least one flapper 60, and preferably two flappers 60, including one on the left and one on the right of the chute 50.

A divider 72 is located between the distribution augers 70 and adjacent to the lower end 54 of the chute 50. This divider 72 includes a crest 74 on an uppermost and most upstream portion of the divider 72 which is located at a midpoint between left and right sides of the chute 50. Sides 76 of the divider 72 taper rearwardly from this crest 74. As material M moves down the angled undersurface 56 of the chute 50, the material M encounters this divider 72 and is split to either the left portion of the auger 70 or the right portion of the auger 70, for converting the flow of material M into a smooth layer of material which has been fed into the screed and onto the surface S of the ground G, before final control of height of the material M by the screed and associated shroud 88 of the screed assembly 80.

Figure 9:
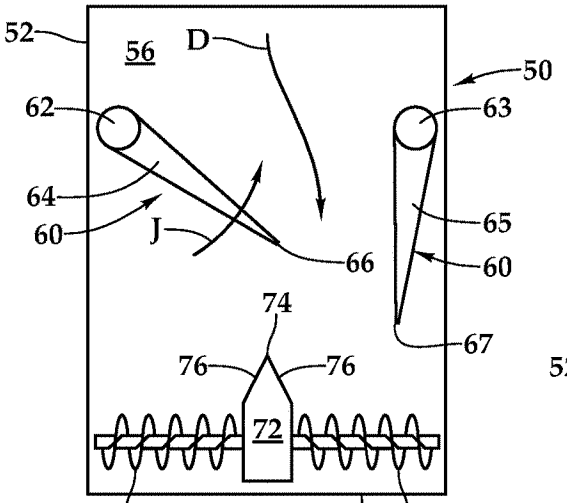
Figure 11:
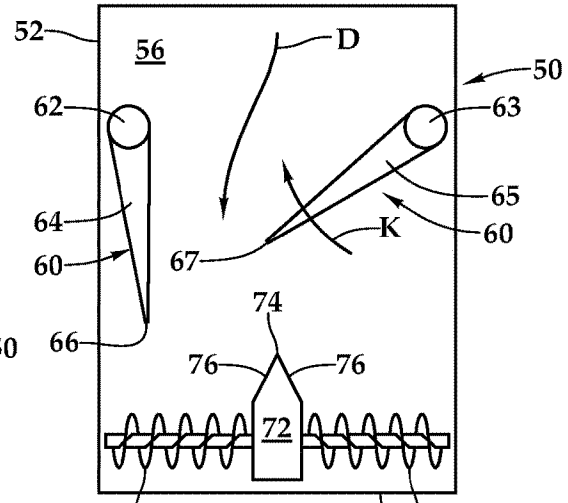

The flappers 60 can be positioned so that a greater or lessor amount of material M goes to the left or to the right augers 70. The flappers 60 include a left hub 62 and right hub 63 about which the flappers 60 pivot. Each of the flappers 60 has an elongate form extending away from the hubs 62, 63 to a left tip 66 and a right tip 67, spaced from the hubs 62, 63 by a left surface 64 and a right surface 65, respectively. These surfaces 64, 65 are preferably planar and define a length of the flappers 60. The surfaces 64, 65 are long enough, so that when one of the flappers 60 is rotated toward a centerline of the chute 50, some proportion (and preferably up to 100%) of the material M can be diverted to either the left side or the right side of the augers 70. When the left hub 62 is fully pivoted, the material M flows to the right side of the auger 70 (FIG. 9). When the right flapper 60 is fully pivoted, all of the material M is diverted to the left side of the augers 70 (FIG. 11).

Figure 7:
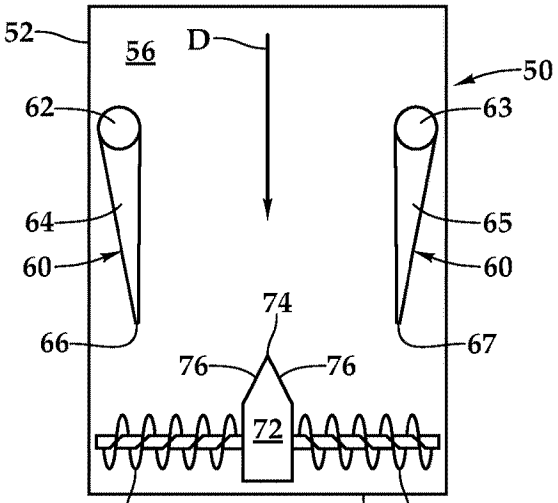
FIGS. 7-11 are plan views of the chute between the output conveyor and the screed assembly, and illustrating how flow diverters in the form of flappers are located at left and right sides of the chute in one embodiment and can be positioned in various different ways to divert greater or lesser proportions of asphalt materials to either a left side or right side of the screed assembly.
Figure 8:
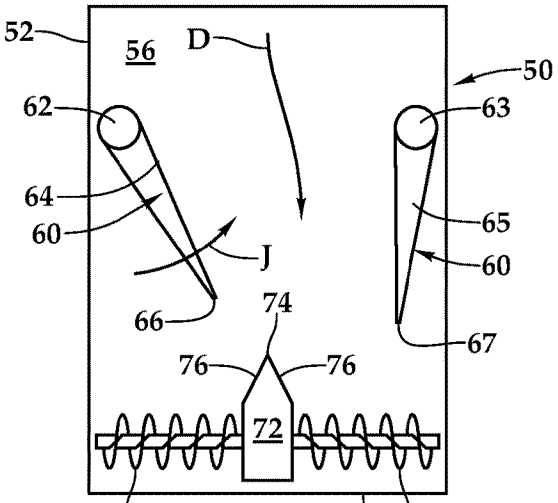

Each of the flappers 60 is preferably controlled by separate motors 68 (FIG. 5) coupled to the hubs 62, 63 of each flapper 60 through drive shafts 69. The various different operational positions of the flappers 60 are illustrated in FIG. 7-11. In FIG. 7, the flappers 60 are shown without any pivoting thereof, and with normal flow of material M over the angled undersurface 56 of the chute 50 from the output conveyor 40 down to the augers 70 ahead of the screed assembly 80. In FIG. 8, the left flapper is rotated partially (along arrow J) to cause a lesser amount of material to flow to the left, and a greater amount of material M to flow to the right of the augers 70.

Figure 10:
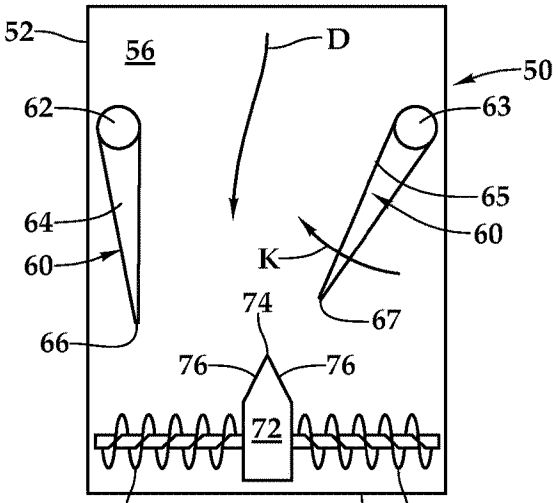

In FIG. 9, the left flapper 60 is shown fully rotated (along arrow J), so that substantially all of the material M is diverted to the right side of the augers 70. In FIG. 10, the right flapper 60 is shown pivoted partially (along arrow K) to divert some of the material M in a greater proportion to the left side of the augers 70. In FIG. 11, the right flapper is more extensively rotated (along arrow K), so that substantially all of the material M is diverted to the left side of the augers 70. Other intermediate positions between those shown in FIGS. 7-11 could also alternatively be utilized.

While the flappers 60 are shown as one exemplary embodiment of flow diverter, as an alternative, a single flow diverter could be mounted to the divider 72 and extending to a tip upstream of a hub located at the divider. Such a single diverter structure could be rotated leftwardly or rightwardly, and cause material M to flow moreso to a left side of the auger 70 or to a right side of the auger 70. As a further alternative, a single flow diverter in the form of a flapper could be mounted centrally closer to an upper end 52 of the chute 50, and extending a downstream direction, and rotatable to divert material M more leftwardly or more rightwardly, to feed material to the left and right side of the screed assembly 80 in a desired fashion to accommodate the particular configuration of the screed assembly 80.

A lower platform 86 adjacent to the screed assembly 80 is preferably provided for an operator to stand (or sit) thereon, such an operator $O_2$ who would typically maintain control a height of the screed assembly 80, and a degree to which a shroud 88 and augers 70 extend laterally to the left and to the right, and also optionally to control positioning of the flappers 60 or other flow diverters and to maintain speed of the output conveyor 40 (or to otherwise maintain an appropriate amount of buffer material M upstream of the screed assembly 80, to keep the material M fully filling the screed assembly 80 and facilitating laying of the pavement).

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A paving system, comprising in combination:

a wheeled vehicle including an asphalt mix carrying hopper;

a conveyor supported by said vehicle and feeding asphalt mix into said hopper, said conveyor located forward of said hopper;

at least one remixer within a lower portion of said hopper;

an output conveyor located at least partially rearward of said remixer and carrying asphalt mix upwardly and rearwardly out of said hopper to a paver subassembly;

said screed assembly including a screed which receives asphalt mix from an output end of said output conveyor to lay down a layer of asphalt behind the screed assembly;

wherein at least one flow diverter is interposed between said output end of said output conveyor and said screed, said flow diverter moving asphalt mix in a greater proportion left or in a greater proportion right, to keep the screed filled in a more balanced fashion with asphalt mix than if no said flow diverter were provided; and wherein said at least one flow diverter includes a flapper of elongate form pivotable about a hub at one end of said flapper, said hub configured to cause said flapper to pivot about an axis non-parallel with a direction of flow of asphalt mix past said at least one flow diverter.

2. The system of claim 1 wherein said at least one flow diverter includes two diverters, including a left diverter and a right diverter.

3. The system of claim 1 wherein said hub of said flapper is coupled to a motor through a drive shaft, said flapper controllable by a controller taken from the group of controllers including a human operator and a feedback and control loop including at least one sensor, said at least one sensor sensing an amount of asphalt mix at at least one location downstream of said at least one flow diverter.

4. The system of claim 1 wherein said wheeled vehicle includes at least two human operator platforms, upon which an operator can be located, said at least two platforms including a screed platform on said screed assembly, and a wheeled vehicle operator platform, said screed platform below and rearward of said wheeled vehicle operator platform.

5. The system of claim 1 wherein said screed assembly is adjustable in height by suspending said screed assembly from said wheeled vehicle through a height adjuster.

6. The system of claim 5 wherein said screed assembly is pivotably supported through at least one support arm to a portion of said wheeled vehicle forward of said screed assembly, and with an actuator for causing pivoting of said screed and said support arm relative to said wheeled vehicle.

7. The system of claim 1 wherein said output conveyor includes a continuous belt rotatable upon spindles, with said the belt including a plurality of ribs extending laterally from a surface of said belt, said output conveyor including a slide surface beneath said belt, said belt located close enough to said slide surface that said belt and said ribs extending at least partially downward from said belt can slide the asphalt mix up said slide surface when said belt is driven to move about said spindles.

8. The system of claim 7 wherein said output conveyor is located within said hopper, and wherein a hood is located above said output conveyor and separating a majority of said output conveyor from asphalt mix that is located within said hopper and above said output conveyor.

9. A paving system, comprising in combination:

a wheeled vehicle including an asphalt mix carrying hopper;

a conveyor supported by said vehicle and feeding asphalt mix into said hopper, said conveyor located forward of said hopper;

at least one remixer within a lower portion of said hopper;

an output conveyor located at least partially rearward of said remixer and carrying asphalt mix upwardly and rearwardly out of said hopper to a paver subassembly;

said screed assembly including a screed which receives asphalt mix from an output end of said output conveyor to lay down a layer of asphalt behind the screed assembly;

wherein at least one flow diverter is interposed between said output end of said output conveyor and said screed, said flow diverter moving asphalt mix in a greater proportion left or in a greater proportion right, to keep the screed filled in a more balanced fashion with asphalt mix than if no said flow diverter were provided;

wherein said at least one flow diverter includes two diverters, including a left diverter and a right diverters; and wherein a middle divider is located downstream of said left diverter and said right diverter and between said left diverter and said right diverter.

10. The system of claim 9 wherein said middle divider has a pointed crest on a portion of said middle divider closest to said output conveyor.

11. The system of claim 9 wherein said left diverter and said right diverter include separate position controllers, allowing said left diverter and said right diverter to pivot independently of each other.

12. A paving vehicle, comprising in combination:

a wheeled frame;

an asphalt material containing hopper;

a mixer within said hopper;

a screed carried by said wheeled frame, said screed located downstream from said hopper;

an output conveyor with at least a lower forward end thereof located within said hopper, and an upper rearward end of said output conveyor leading from said lower forward end toward said screed;

wherein said mixer within said hopper includes an auger rotating about an axis non-parallel with a direction of flow of said asphalt material along said output conveyor;

wherein said output conveyor includes a belt with a plurality of ribs extending laterally from said belt, said belt rotating upon at least two spindles at opposite ends of said belt, and with a slide surface located beneath said belt and close enough to said belt that asphalt material slides up said slide surface when said belt is rotating about said spindles with a lower portion of said belt moving upward along a path parallel with said slide service;

wherein a chute is located downstream of said output conveyor and upstream of said screed, said chute including at least one flow diverter adjacent thereto and movable to divert flow of asphalt material exiting said output conveyor in a greater proportion to a left side of said screed or in a greater proportion to a right side of said screed; and wherein a small hopper sized smaller then said hopper including said mixer therein, is located downstream of said chute and upstream of said screed, and wherein at least one distribution auger is located between said small hopper and said screed.

13. The vehicle of claim 12 wherein a loading conveyor is coupled to said wheeled frame and positioned to move asphalt material from in front of said wheeled vehicle to within said hopper.

* * * * *